US010143248B2

(12) United States Patent
Hull

(10) Patent No.: US 10,143,248 B2
(45) Date of Patent: Dec. 4, 2018

(54) SAFETY GLOVE WITH FINGERTIP PROTECTIVE MEMBER

(71) Applicant: Summit Glove Inc., Minerva, OH (US)

(72) Inventor: James L. Hull, Malvern, OH (US)

(73) Assignee: Summit Glove Inc., Minerva, OH (US)

( * ) Notice: Subject to any disclaimer, the term of this patent is extended or adjusted under 35 U.S.C. 154(b) by 29 days.

(21) Appl. No.: 15/185,097

(22) Filed: Jun. 17, 2016

(65) Prior Publication Data

US 2016/0366959 A1 Dec. 22, 2016

Related U.S. Application Data

(60) Provisional application No. 62/181,967, filed on Jun. 19, 2015.

(51) Int. Cl.
*A41D 19/01* (2006.01)
*A41D 19/015* (2006.01)

(52) U.S. Cl.
CPC .... *A41D 19/01517* (2013.01); *A41D 2400/70* (2013.01)

(58) Field of Classification Search
CPC ..... A41D 19/015; A41D 19/01517; A41D 19/01547; A41D 19/01511; A41D 19/01505; A41D 19/01576; A41D 19/01582
USPC ..... 2/161.6, 159
See application file for complete search history.

(56) References Cited

U.S. PATENT DOCUMENTS 2,114,022 A 1/1935 Jensen
2,842,771 A * 7/1958 Foti ..... A41D 19/01529 2/159
2,849,786 A * 9/1958 Ashley ..... A41D 19/0065 2/159
3,732,575 A * 5/1973 Pakulak ..... A41D 19/01517 2/16
4,061,709 A 12/1977 Miller et al.
4,172,293 A * 10/1979 Vistins ..... A41D 13/04 156/280
4,694,508 A 9/1987 Iriyama et al.
4,696,065 A 9/1987 Elenteny
(Continued)

OTHER PUBLICATIONS

68NFW Nitty Gritty. Downloaded from website: www.showa-europe.com/glove/68nfw-nitty-gritty-anti-cut-grip-aramid-knit-natural-latex-impregnation, on Mar. 16, 2016.

*Primary Examiner* — Shaun R Hurley
*Assistant Examiner* — Bao-Thieu L Nguyen
(74) *Attorney, Agent, or Firm* — Sand & Sebolt

(57) ABSTRACT

A safety glove having a protective member or insert extending around the fingertip of the safety glove is provided. The protective member may be positioned along the outer surface or the inner surface of the glove. Alternatively, the protective member may be integrally formed between two layers of glove material. The protective member terminates distally from an interphalangeal joint line to enable finger flexion in order to grasp an item, such as a slab of meat to be deskinned in a skinning machine. The glove may include a rough outer surface formed from thrice dipping the glove and allowing the glove to cure. Additionally, the glove may have a width near the wrist that is wider than the width near the palm to enable the glove to be rapidly removed (i.e., doffed) in an emergency event of the glove getting caught in a rotating blade on the skinning machine.

13 Claims, 5 Drawing Sheets

(56) References Cited

U.S. PATENT DOCUMENTS 4,779,289 A 10/1988 Prouty
4,942,626 A 7/1990 Stern et al.
4,995,119 A * 2/1991 Codkind ..... A41D 19/0058 2/161.6
5,083,973 A 1/1992 Townsend
5,093,933 A * 3/1992 Berry ..... A41D 19/01517 2/161.6
5,113,532 A * 5/1992 Sutton ..... A41D 19/0058 2/16
5,224,363 A * 7/1993 Sutton ..... A41D 19/0058 2/16
5,459,880 A * 10/1995 Sakaki ..... B29C 41/14 2/161.6
5,500,957 A * 3/1996 Stein ..... A61B 42/10 2/169
5,564,127 A * 10/1996 Manne ..... A61B 42/10 2/161.7
5,817,433 A 10/1998 Darras
6,012,170 A * 1/2000 Kim ..... A41D 19/01582 2/158
6,360,373 B1 3/2002 Rehn et al.
6,711,746 B1 * 3/2004 Orellana ..... A41D 19/0157 2/160
6,871,359 B2 * 3/2005 Han ..... A41D 19/0006 2/161.6
6,973,675 B2 12/2005 Cheng
7,089,600 B2 * 8/2006 Morita ..... A41D 19/0065 2/161.6
7,284,283 B2 * 10/2007 Mack ..... A41D 19/015 2/16
7,725,979 B1 * 6/2010 Held ..... A47K 7/03 15/104.94
D622,030 S * 8/2010 Thompson ..... D2/617
8,104,097 B2 * 1/2012 Hamann ..... A41D 19/0058 2/159
8,413,469 B2 * 4/2013 Lapp ..... A41D 19/01505 2/16
8,656,518 B2 * 2/2014 Saunders ..... A41D 19/0096 2/161.6
8,863,316 B2 * 10/2014 Gaskins ..... A41D 19/01547 2/161.1
9,198,474 B1 * 12/2015 Hacobian ..... A41D 19/01505
2004/0187189 A1 9/2004 Morita
2005/0028244 A1 2/2005 Roeckl
2006/0150300 A1 * 7/2006 Hassan ..... A41D 19/0058 2/161.6
2008/0216209 A1 * 9/2008 Kim ..... A41D 19/01505 2/161.8
2009/0068443 A1 * 3/2009 Curtet ..... A41D 19/0055 428/332
2009/0126074 A1 5/2009 Mattesky
2011/0258755 A1 * 10/2011 Arfi ..... A47L 13/18 2/161.6
2011/0287553 A1 11/2011 Hassan et al.
2015/0143608 A1 * 5/2015 Loo ..... B29D 99/0067 2/161.6
2015/0313298 A1 11/2015 Bailey
2015/0374052 A1 * 12/2015 Pimentel de Oliveira ..... A41D 19/0006 2/161.6
2016/0143379 A1 * 5/2016 Hull ..... A41D 19/0044 2/161.6

* cited by examiner

SAFETY GLOVE WITH FINGERTIP PROTECTIVE MEMBER

CROSS-REFERENCE TO RELATED APPLICATIONS

This application claims the benefit of prior U.S. Provisional Patent Application Ser. No. 62/181,967 filed Jun. 19, 2015, the disclosure of which is entirely incorporated herein by reference.

BACKGROUND

Technical Field

The present disclosure relates generally to gloves. More particularly, the present disclosure is directed to work gloves for use in the food processing industry. Specifically, the present disclosure is directed to a protective work glove that includes an etched exterior layer which has improved abrasion resistance and a protective member integrally formed at the tip of each finger and thumb.

Background Information

In many industries it is both desirable and necessary for workers to wear protective gloves. One of these industries is the food processing industry, particularly the meat packing industry. In the meat packing industry, many workers have to use knives during the performance of their jobs and, thus, there is a risk of accidentally cutting through the glove and injuring the worker's hand. It is therefore vital that a cut-resistance glove be worn in these particular occupations. Other workers use motorized machinery to perform tasks. One such machine is a deriding skinner which is utilized to simultaneously remove skin and a layer of fat from carcasses during meat processing. These skinners are configured to remove tough, thick layers of skin from a carcass. Consequently, workers gloves have to be strong and abrasion resistant so as to try and prevent a worker's hand from being badly hurt if it coming into contact with the blade region of a deriding skinner.

A number of patents are directed to protective gloves which are cut-resistant and abrasion resistant. For example, U.S. Pat. No. 4,172,293 and a protective glove commercially known as "Best Nitty Gritty" manufactured by Showa Best Glove of Menlo, Ga.

SUMMARY

Issues continue to exist with protective gloves insofar as they still may lack adequate protection in the fingertip region. Thus, a need exists for an improved protective glove used in the meat packing industry. The present disclosure addresses these and other issues.

In one aspect, an embodiment of the present disclosure may provide a protective glove comprising: a flexible first layer; a hardened second layer; a flexible third layer; a tip of a finger region adapted to receive a user's finger therein; and wherein the hardened second layer is between the flexible first and third layers adjacent the tip of the finger region.

In another aspect, an embodiment of the present disclosure may provide a protective glove comprising: a distal tip of a finger region adapted to receive a user's finger therein; a flexible first layer extending over a distal tip of a finger region; a hardened second layer extending over the distal tip of the finger region and positioned entirely distal from an interphalangeal join plane; and an indicator layer extending over the distal tip of the finger region positioned between the first layer and the second layer, wherein the indicator layer provides a visual identifier to a user in the event that the flexible first layer is broken.

In another aspect, an embodiment may provide a method comprising the steps of: donning a protective work glove including a protective layer adjacent a tip of a finger region on the glove, wherein the protective layer is fabricated from a hardened material and is positioned between two layers of flexible material; skinning meat in a skinning device including a rotating blade; wherein the protective layer protects a user from injury if the protective work glove contacts the rotating blade.

In another aspect, an embodiment of the present disclosure may provide a protective glove comprising: a proximal wrist end opposite a distal fingertip end; a first finger sleeve including a distal tip; and a protective member adjacent the distal tip and positioned distal from an interphalangeal joint line, wherein the protective member is hardened relative to the first finger sleeve.

In another aspect, an embodiment of the present disclosure may provide a method comprising the steps of: donning a protective work glove including a protective layer adjacent a tip of a finger region on the glove, wherein the protective layer is fabricated from a hardened material and is positioned between two layers of flexible material; skinning meat in a skinning device including a rotating blade; and protecting a wearer from injury if the protective work glove contacts the rotating blade.

In another aspect, an embodiment of the present disclosure may provide a safety glove having a protective member or insert extending around the fingertip of the safety glove. The protective member may be positioned along the outer surface or the inner surface of the glove. Alternatively, the protective member may be integrally formed between two layers of glove material. The protective member terminates distally from an interphalangeal joint line to enable finger flexion in order to grasp an item, such as a slab of meat to be deskinned in a skinning machine. The glove may include a rough outer surface formed from thrice dipping the glove and allowing the glove to cure. Additionally, the glove may have a width near the wrist that is wider than the width near the palm to enable the glove to be rapidly removed (i.e., doffed) in an emergency event of the glove getting caught in a rotating blade on the skinning machine.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1:
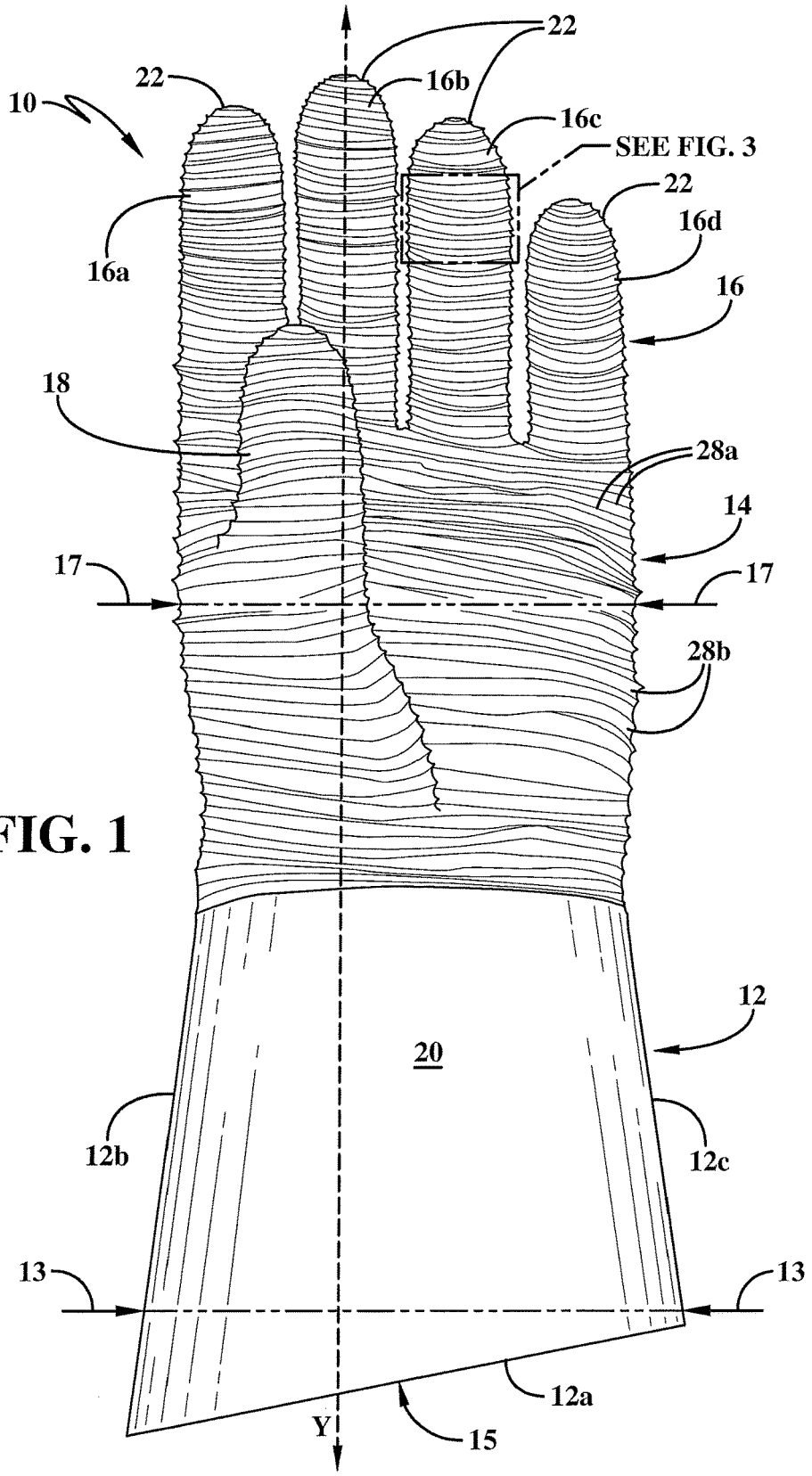
FIG. 1 is a front elevation view of a protective work glove in accordance with an aspect of the present invention.
Figure 2:
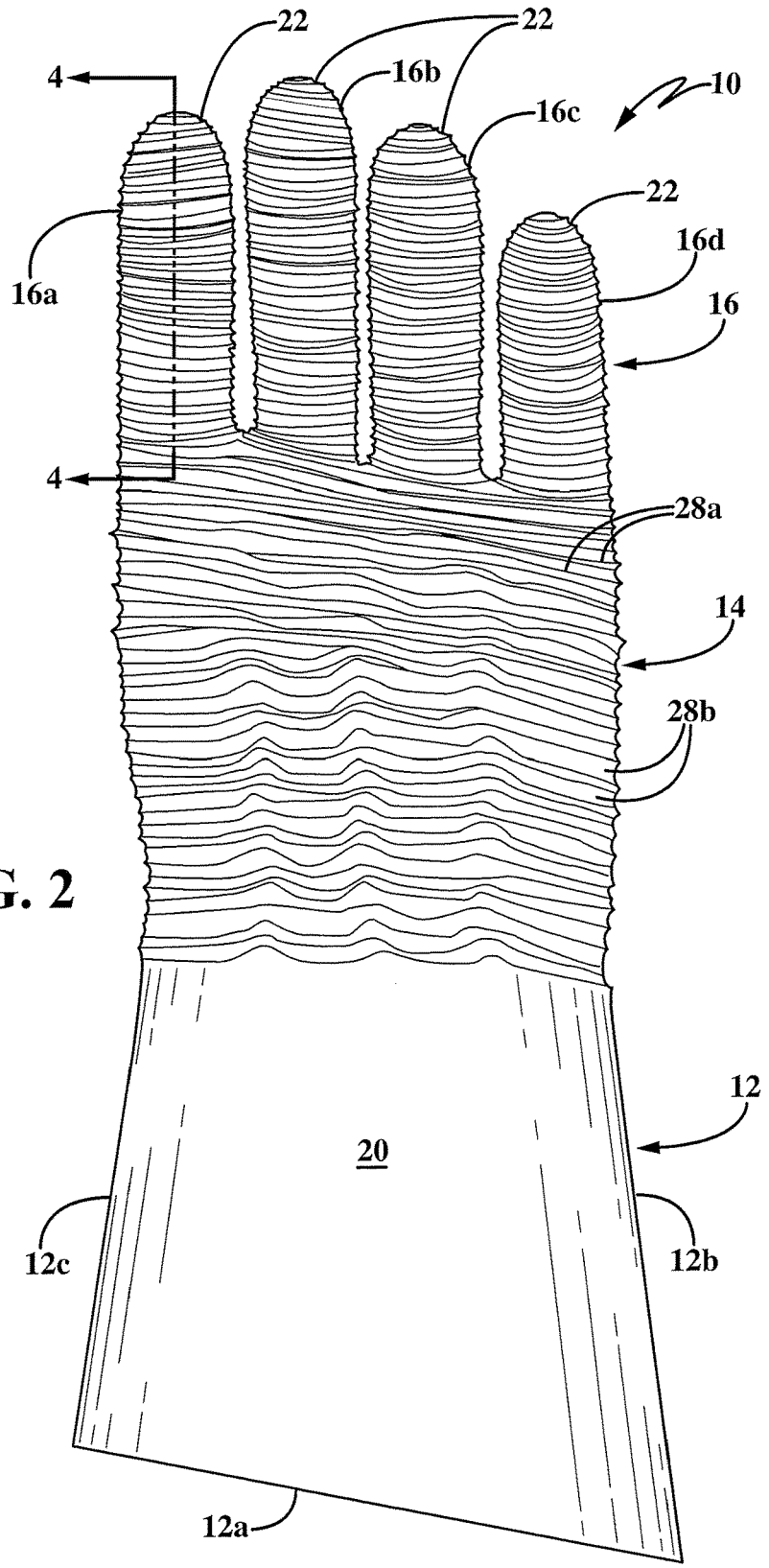
FIG. 2 is a rear elevation view of the protective work glove of FIG. 1.

Referring to FIGS. 1-6 there is shown a work glove in accordance with an aspect of the present invention, generally indicated at 10. Glove 10 comprises a wrist region 12, a palm region 14, finger regions 16 and a thumb region 18. Glove 10 is configured to receive a user's hand therein through an opening (not shown) but defined in a first end 12*a* of wrist region 12.

Wrist region 12 is configured to cover a portion of a user's wrist and forearm and first end 12*a* thereof is preferably angled such that a first side 12*b* of wrist region 12 is longer than a second side 12*c* thereof. First side 12*b* is that side which is located adjacent thumb region 18.

Wrist region 12 has a first width 13 when glove 10 is laid flat. The wrist region 12 width is widest portion of the glove 10 and defines an opening 15 through which a user or wearer is intended to insert their hand.

Palm region 14 is positioned distally from wrist region 12 and positioned proximal from first end 12*a*. Palm region 14 is configured to cover the palm of the user's hand and the back (i.e., dorsal portion) of their hand. Palm region 14 has a second width associated with it which may referred to as second width 17. Second width 17 is less than the first width 13 of the wrist region 12. As such, when glove 10 is laid flat, side edges 12*b*, 12*c* taper inwardly from wrist region 12 towards palm region 14. By enabling wrist region 12 to have a greater width than that of palm region 14, glove 10 is enabled to rapidly and easily be pulled from the wearer's hand. The rapid doffing may occur during the meat skinning process if the distal tip of the glove is caught in a rotating blade.

Finger region 16 extends distally outward from palm region 14 in a direction opposite to wrist region 12. Finger region 16 include the index finger region 16*a*, middle finger region 16*b*, ring finger region 16*c*, and little finger region 16*c*. The respective finger regions are defined by finger sleeve coverings formed of glove material. The finger sleeves are similarly labeled by reference numerals 16*a*, 16*b*, 16*c*, and 16*d*.

Thumb region 18 also extends outwardly from palm region 14 in a direction generally opposite to wrist region. Thumb region 18 is located in front of finger region 16.

Figure 4:
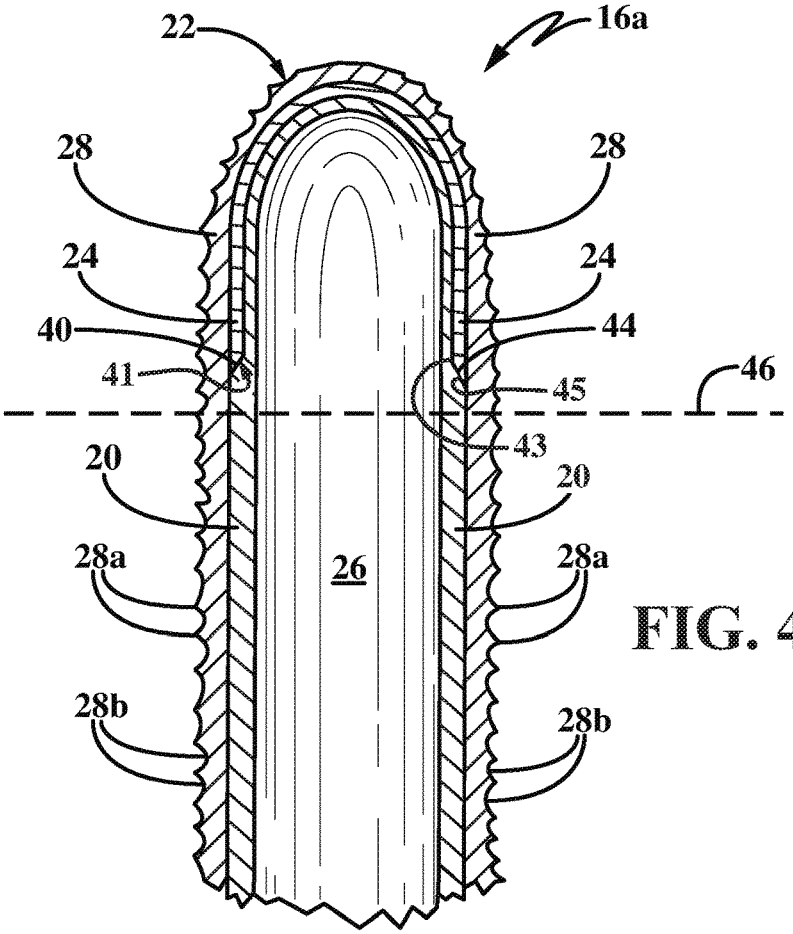
FIG. 4 is a longitudinal cross-section of a finger region of the work glove taken along line 4-4 of FIG. 2.

In accordance with an aspect of the present invention and as illustrated in FIG. 4, glove 10 may be fabricated from a first layer 20. First layer 20 forms part of every region of glove 10. Thus, first layer 20 is provided as part of wrist region 12, palm region 14, finger region 16 and thumb region 18. FIG. 1 shows that first layer 20 is the exterior layer covering most of wrist region 12. First layer 20 is of substantially the same thickness over the entire glove 10 with the exception of the tips of each respective finger region 16*a*, 16*b*, 16*c*, and 16*d*. As illustrated in FIG. 4, in the tip 22 of each digit, such as index finger region 16*a*, first layer 20 is thinner than over the rest of glove 10 and a protective member 24 of material is provided exteriorly of first layer 20. In one embodiment, the protective member 24 may be a hardened acrylic and provides additional protection in the tips 22 of each finger. A liner of drilled cotton 26 may be provided interiorly of first layer 20. This drilled cotton liner 26 makes glove 10 more comfortable to wear as it is gentle on the skin and also absorbs perspiration from the user's hand. The drilled cotton liner 26 is secured to first layer 20 in any suitable manner, however normally the cotton liner 26 is fitted to a mold and dipped into liquid rubber creating adhesion between the two. Further, alternative to drilled cotton liner 26, a liner of interlock or jersey cotton may be utilized to provide comfort for the user's skin.

The protective member 24 is integrally formed in glove 10 extending from a first end 40 over and around a distal tip region 22 of each finger region 16 to a second end 44. In the embodiment described above, protective member 24 is a hardened acrylic or hardened rubber however, other hardened materials used to protect the tip region 22 of each finger region 16 are entirely possible. For example, hardened polymers, Kevlar, hardened milled rubbers, and various other hardened non-metals may suffice. It may be undesirable in some instances to use a metal as protective member 24 because protective member 24 is designed to protect the tips of a user's fingers when inside the glove in the event the glove comes in contact with the metal blade on the skinner. The use of a metal protective member 24 contacting a rotating metal blade on the skinning device may damage the blade on the skinning device. However, it may be entirely possible to use a softer metal such as aluminum to fabricate protective member 24.

The first and second ends 40, 44 of protective member 24 terminate distally relative to a distal interphalangeal joint line 46, The interphalangeal line 46 is an imaginary line drawn at the location of the distal interphalangeal joint of a user's hand when the glove 10 is worn. The advantage of terminating protective member 24 distally from interphalangeal line 46 is that this design permits a user to continue to have a full range of motion in flexing the distal interphalangeal joint line 46 while protecting the tip regions 22 of their fingers with a solid protective member 24, The first and second ends 40,44 form a portion of an annular edge 41 defining an opening 43 opposite a tip of the protective member 24, wherein the annular edge 41 is positioned entirely distal of the interphalangeal line 46 associated with the first finger sleeve 16*a*. The annular edge 41 tapers towards the second end 40 of the protective member to thereby define a tapered surface 45.

Protective member 24 is integrally formed between first layer 20 and a second etched outer layer 28 (described in further detail below). In one embodiment, the integral formation of a protective member 24 sandwiched between first layer 20 and second layer 28 is accomplished by adhering protective member 24 to first layer 20 with an adhesive and then coating second layer 28 over first layers 20 and protective member 24. In other embodiments, no adhesive is needed to secure protective member 24 to first layer 20.

In accordance with another aspect of the present invention, the second layer 28 of etched material is provided exteriorly over first layer 20 across all of the finger regions 16, the thumb region 18, the palm region 14 and a portion of wrist region 12 adjacent palm region. The second layer 28 comprises a plurality of randomized alternating ridges 28*a* and valleys 28*b*. The ridges 28*a* and valleys 28*b* are oriented generally horizontally relative to a longitudinal axis "Y" (FIG. 1) of glove 10.

Figure 3:
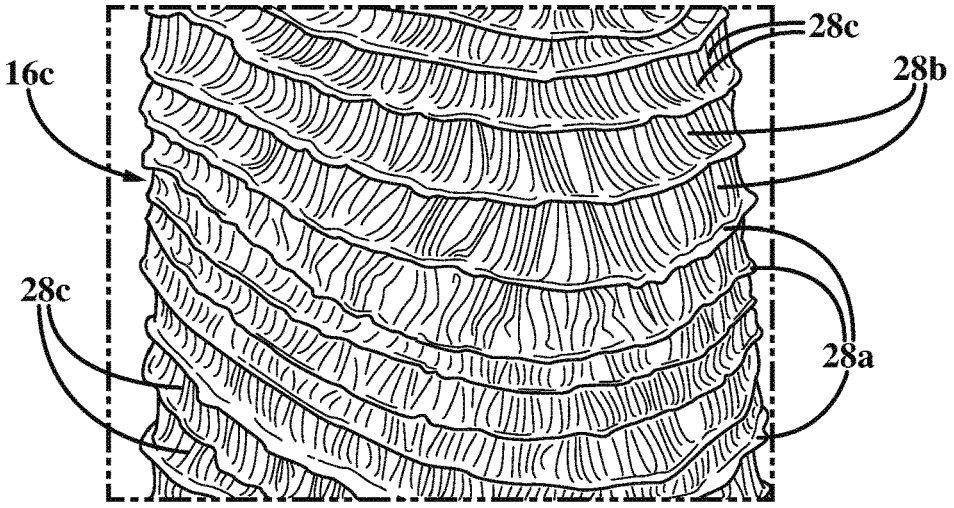
FIG. 3 is an enlarged front view of the highlighted region of FIG. 1 and showing the etched rubber on the exterior surface of at least part of the work glove.

In accordance with yet another aspect of the present invention, second layer 28 also includes a plurality of striations 28*c*, seen best in FIG. 3. Striations 28*c* are generally aligned with longitudinal axis "Y". Striations 28*c* extend across each individual valley 28*b* generally from one ridge 28*a* to the adjacent ridge 28*a*. The ridges 28*a*, valleys 28*b*, and striations 28*c* provides improved abrasion resistance to glove 10. The material of second layer 28 may be natural rubber that is milled, formed, and compressed rubber. The outer etching second layer 28 defining ridges 28*a*, valley 28*b*, and striations 28*c* defines a very rough outer surface of glove 10. The rough outer surface is advantageous in the meat packing industry to allow grease and water to drain through various channels defined by the valleys 28*b* and striations 28*c* so that glove 10 is less slippery, especially when working with pork and chicken. The etching of second layer 28 is formed as glove 10 is dipped in liquefied first layer and liquefied second layer material. It is entirely possible and foreseen that other methods of forming a rough surface around a protective member 24 would be entirely possible other than forming it through a dipped process.

Figure 5:
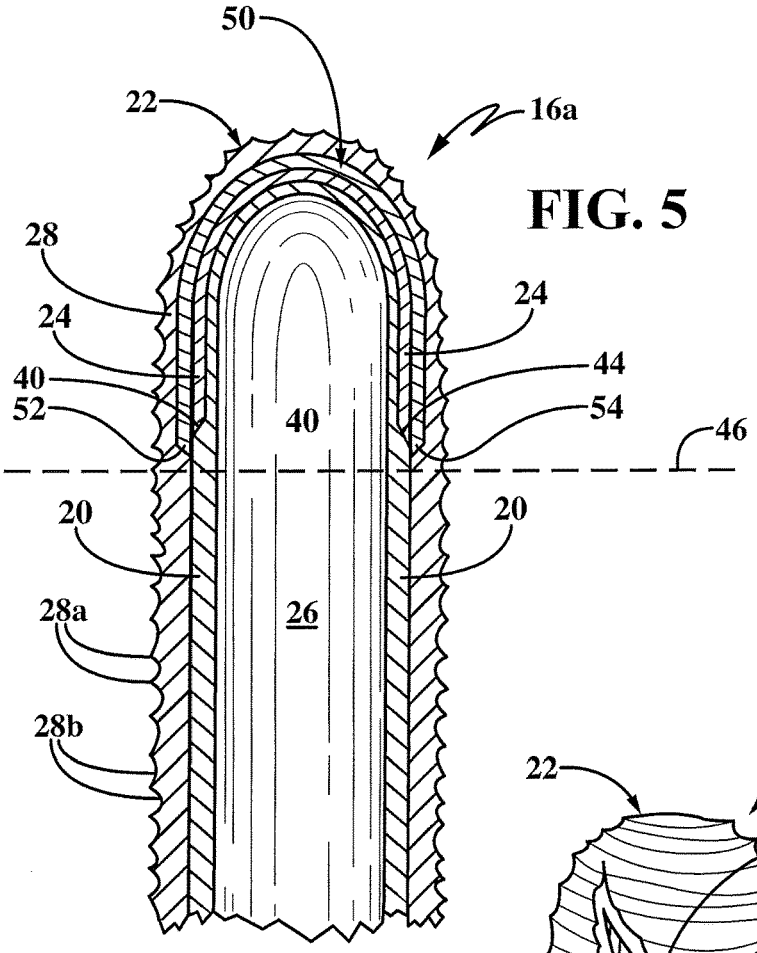
FIG. 5 is a longitudinal cross-section of a finger region of the work glove taken along line 4-4 of FIG. 2 including an indicator layer positioned between a flexible outer layer and a hardened layer.

As depicted in FIG. 5, another aspect of protective glove 10 includes an indicator layer 50. Indicator layer 50 extends from a first end 52 around the tip 22 to a second end 54. First end 52 and second end 54 of indicator layer 50 are both distal of interphalangeal joint 46. Indicator layer 50 is positioned between hardened protective member 24 and flexible outer second layer 28. Indicator layer 50 is preferably fabricated from acrylic in combination with styrene-butadiene rubber (SBR). Indicator layer 50 has a color that is different than that of flexible outer second layer 28 such that indicator layer 50 provides a visual indicator in the event that flexible outer second layer 28 is ripped or torn or otherwise broken. In one exemplary embodiment, indicator layer 50 is an orange color visually distinct from the color associated with outer flexible second layer 28.

While FIG. 5 details an embodiment of glove 10 having indicator layer 50 to provide a visual representation in the event the flexible outer second layer 28 is torn, it is entirely possible that an embodiment of FIG. 4 having only a hardened protective member 24 and a flexible outer second layer 28 is utilized and wherein the hardened protective member 24 is dyed a color different than that of the flexible outer second layer 28. If this version is employed, the hardened protective member 24 may be an orange thimble-like member that visually identifies a cut or tear or rip or otherwise break in the flexible outer second layer 28 of glove 10.

Figure 6:
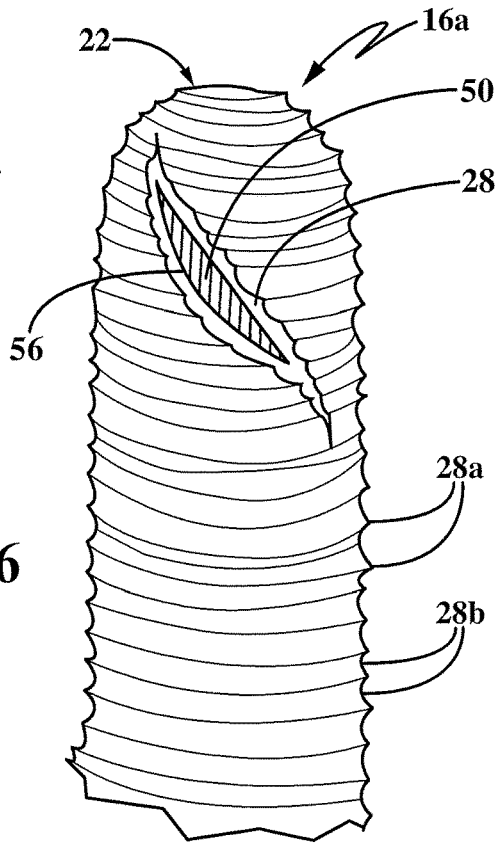
FIG. 6 is an enlarged elevation view of a finger region of the work glove detailing a rip or tear or cut in an outer flexible layer such that an indicator layer is visible to provide a visual identifier that the glove is broken and needs replaced.

As depicted in FIG. 6, an exemplary tear or rip 56 is shown near the tip of a finger region of glove 10. The tear or rip 56 extends entirely through flexible outer second layer 28 revealing indicator layer 50 there beneath. Indicator layer 50 shows itself through the aperture defined by tear 56 in order to provide a visual indicator to the user that the glove is broken and needs replaced.

It will be understood that the style of glove 10 illustrated in these figures is a hand-specific glove, but other styles of glove, such as puppet gloves or mitts may utilize include the features of glove 10 which provide improved abrasion resistance.

A pair of gloves 10 in accordance with the above description and figures was fabricated and tested for abrasion resistance. Glove 10 is fabricated by forming the liner of drilled cotton 26 over a mold in the desired shape or form of resultant glove 10. The drilled cotton liner 26 may then be dipped into a liquid solution of first layer 20 and then removed allowing first layer 20 to cool. Protective member 24 may be attached via an adhesive to the tip end 22 of first layer 20. Thus, protective member 24 may be pre-hardened and secured to glove. Alternatively, the cotton liner 26 and first layer 20 may have the finger tips 22 dipped into an acrylic or polymer solution and removed and cured to form protective member 24. Thereafter, portions of the glove having first layer 20 and protective member 24 adhered thereto may be dipped into a bath of liquid second layer material wherein second layer 28 is then permitted to cool. The milled features 28*a*, 28*b*, 28*c* of second layer 28 may be formed while second layer 28 cools and cures. Second layer 28 may be a natural rubber, Acrynitrile Butadiene Rubber, or Chloroprene. Similarly, first layer 20 may be a natural rubber, Acrynitrile Butadiene Rubber, or Chloroprene. Alternatively, first layer 20 and second layer 28 may also be pre-vulcanized latex.

When the layers are formed from pre-vulcanized latex, glove 10 may be dipped at least three times into the bath of liquid pre-vulcanized latex layer material. By dipping three times, glove 10 is formed thicker than conventional protective gloves in the meat packing industry. The thrice dipped thick glove 10 is semi-stiff or semi-rigid and less flexible than conventional protective glove. The thrice dipped thick glove 10 layer 28 which includes a first sub-layer, a second sub-layer, and a third sub-layer formed from dipping the mold at least three times in a bath of liquefied layer 28 material. One exemplary, non-limiting advantage of a thrice dipped semi-rigid glove 10 is that the rigid form enables the glove to be removed from the hand (i.e., doffed) very quickly in the event of an emergency with the glove getting caught in the machine. The thick glove 10 having the wider first width 13 also assists with rapid removal of thick glove 10 in such an emergency.

In the embodiment of glove 10 that includes indicator layer 50 positioned between outer second layer 28 and the hardened protective member 24, the indicator layer 50 is applied over the hardened member 24. Then the glove with the indicator layer 50 is dipped into a liquid bath of the second layer 28 such that the dipping process seals indicator layer 50 therebetween the second layer 28 and the hardened protective member 24.

Once glove 10 is fabricated, a user dons the glove by inserting their hand into the interior portions of the glove contacting cotton liner 26. User may then grasp a piece of meat that needs skinned in a skinning device. When grasping the meat, the etched second layer 28 contacts the meat and provides a gripping surface with the plurality of randomized alternating ridges 28*a* and valleys 28*b*. Additionally, the material of first layer 20 and second layer 28 allow the user to flex their fingers to assist in the gripping of the meat. Further, with protective member 24 integrally formed between first and third layer entirely distal of the interphalangeal line 46, the tips 22 of a user's fingers are protected when manipulating the meat onto the skinning device while still allowing fingers to flex about the interphalangeal joint.

During the skinning process, the user guides the meat over a rotating blade narrowly exposed through a hole defined in a skinning table top (i.e., a deriding skinner machine). The user may rest the tips of the glove on the table top and move the piece of meat over the hole having the rotating skinning blades moving therein. In the event that tip region 22 of glove 10 comes into contact with the rotating blade, the protective member 24 made of hardened material will protect the tips of a finger in a thimble-like manner. Stated otherwise, protective member 24 may be generally cup-shaped to cover the tips of a wearer's fingers such that the cup-shaped protective member terminates between the base of a wearers finger nail and the interphalangeal joint. One exemplary and non-limiting deriding skinner machine is manufactured and commercially available for sale under the name "SK 15-340 Pork Skinner" by Marel hf of Reykjavik, Iceland.

Figure 7:
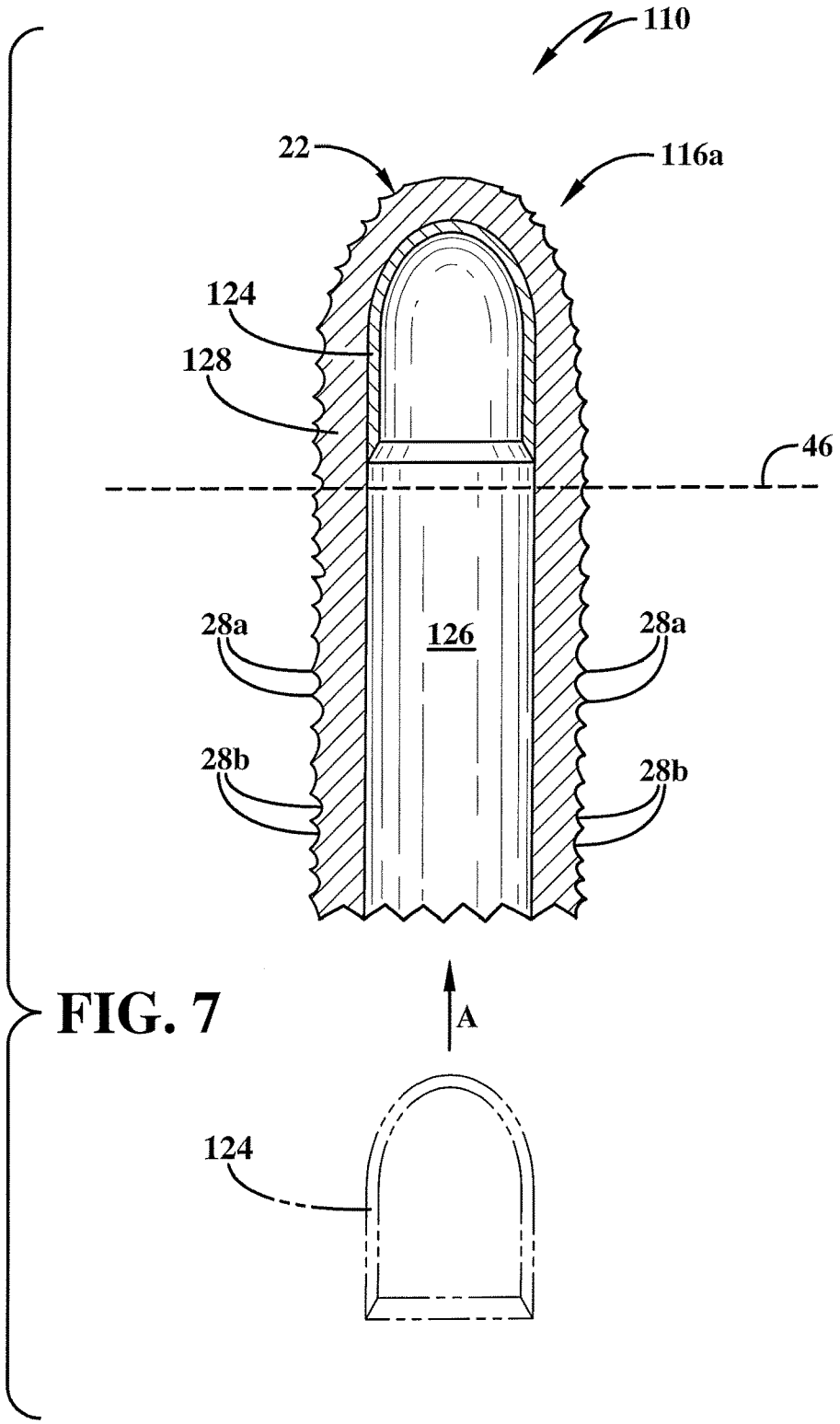
FIG. 7 is a cross section view of a finger region for an alternative embodiment glove having a protective member therein.

FIG. 7 depicts a first finger region 116*a* of a protective glove 110 in accordance with one aspect of an alternative embodiment of the present disclosure. Glove 110 is formed from a single layer 128 of flexible material. The single layer 128 may form similar rough surfaces (i.e., 28*a*, 28*b*) to provide suitable grip during the meat handling process. However, unlike glove 10 which has an integrally formed protective member 24, glove 110 is designed to utilize a protective member 124 which may be retrofitted to an existing protective glove. Stated otherwise, glove 110 is formed by retrofitting an ordinary and usual non-slip glove utilized in the meat packing industry with the protective member 124 inserted into the fingertip region. FIG. 7 depicts the step of retrofitting an ordinary meat packing protective glove into glove 110 by inserting protective member 124 into the fingertip in the direction of Arrow A.

Protective member 124 may fit into the inner surface of layer 128 via a frictional interference fit, or may be attached with a thin layer of adhesive. Alternatively, protective member 124 may fit interiorly of a liner 126 and be connected thereto. In each instance, protective member 124 is shaped similar to a thimble and has an end that terminates distally from imaginary interphalangeal joint line 46, similar to that of glove 10.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A protective glove comprising:

a proximal wrist end opposite a distal fingertip end;

a first finger sleeve including a distal tip;

a liner defining a portion of the first finger sleeve, a layer of material connected with the liner defining the portion of the first finger sleeve;

a protective member adjacent the distal tip and positioned distal from an interphalangeal joint line between the liner and the layer of material, wherein the protective member is hardened relative to the first finger sleeve; and wherein the protective member includes a first end extending from the distal fingertip end to a second end that defines an annular edge defining an opening to the protective member adapted to receive a tip of a finger therein, wherein the annular edge tapers towards the second end of the protective member.

2. The glove of claim 1, wherein the protective member is positioned interior the layer of material and extending around the distal tip inside the glove.

3. The glove of claim 1, further comprising an indicator layer positioned between the protective member and the layer of material.

4. The glove of claim 3, wherein the indicator layer is acrylic in combination with styrene-butadiene rubber (SBR).

5. The glove of claim 3, wherein the indicator layer has a color that is different than that of the layer of material adapted to provide a visual indicator if the layer of material is ripped, torn, cut, or otherwise broken.

6. The glove of claim 3, wherein the protective member has a color that is different than that of the layer of material adapted to provide a visual indicator if the layer of material is ripped, torn, cut, or otherwise broken.

7. The glove of claim 1, wherein the layer of material is selected from the group comprising: natural rubber, milled rubber, Acrylonitrile Butadiene Rubber, Chloroprene, aluminum, and pre-vulcanized latex.

8. The glove of claim 1, wherein the protective member is positioned entirely distal of the interphalangeal joint line.

9. The glove of claim 1, wherein the outer surface of the layer material on the first finger sleeve is formed from dipping the glove in liquefied material that defines the layer of material when cured, wherein the outer surface on the first finger sleeve includes a plurality lateral ridges that are spaced apart and extend at least partially circumferentially around the first finger sleeve and includes vertical striations extending between adjacent lateral ridges and valleys defined between adjacent striations adapted to drain grease byproduct therealong during a meat skinning process.

10. A protective glove comprising:

a proximal wrist end opposite a distal fingertip end including side edges that taper inwardly towards a longitudinal axis from the proximal wrist end towards a palm region;

four finger sleeves and one thumb sleeve, wherein each sleeve includes a distal tip;

a liner of material defining a portion of each one of the sleeves;

a layer of material connected with the liner of material;

five protective members, wherein one protective member is connected with one sleeve between the liner of material and the layer of material adjacent the distal tip and positioned distal from an interphalangeal joint line, wherein each protective member is hardened relative to the sleeves, and each protective member includes a first end extending from around the distal tip of each sleeve to a second end that defines an annular edge defining an opening to the protective member adapted to receive a tip of a finger therein, wherein the annular edge tapers towards the second end of the protective member; and an outer surface defined by the layer of material, wherein the outer surface on the four finger sleeves includes a plurality of lateral ridges that are spaced apart and extend at least partially circumferentially around each one of the four finger sleeves and includes vertical striations extending between adjacent lateral ridges and valleys defined between adjacent striations adapted to drain grease byproduct therealong during a meat skinning process.

11. The protective glove of claim 10, wherein the layer of Material includes a first sub-layer, a second sub-layer, and a third sub-layer formed from dipping a mold carrying the liner of material at least three times in a bath of liquefied layer material.

12. The protective glove of claim 11, further comprising:

a visual indicator established by each one of the five protective members having a different color than the layer of material to visually identify a cut, tear, rip, or rupture in the layer of material.

13. A protective glove comprising:

a proximal wrist end opposite a distal fingertip end;

a first finger sleeve including a distal tip that has five layers when viewed in cross section, the five layers including:

a liner defining a portion of the first finger sleeve;

a first layer of material connected to the liner defining the portion of the first finger sleeve, a second layer of material connected with the first layer of material defining the portion of the first finger sleeve;

a protective member adjacent the distal tip and positioned distal from an interphalangeal joint line, wherein the protective member is hardened relative to the first finger sleeve and wherein the protective member includes an annular edge defining an opening to the protective member; and an indicator layer indicator layer positioned between the protective member and the second layer of material.

* * * * *